US009388736B2

(12) United States Patent
Naitoh

(10) Patent No.: US 9,388,736 B2
(45) Date of Patent: Jul. 12, 2016

(54) FREE-PISTON ENGINE

(75) Inventor: Ken Naitoh, Tokyo (JP)

(73) Assignee: WASEDA UNIVERSITY, Tokyo (JP)

( * ) Notice: Subject to any disclaimer, the term of this patent is extended or adjusted under 35 U.S.C. 154(b) by 14 days.

(21) Appl. No.: 14/235,713

(22) PCT Filed: Aug. 8, 2012

(86) PCT No.: PCT/JP2012/070175

§ 371 (c)(1),
(2), (4) Date: Mar. 14, 2014

(87) PCT Pub. No.: WO2013/022019

PCT Pub. Date: Feb. 14, 2013

(65) Prior Publication Data

US 2014/0283791 A1 Sep. 25, 2014

(30) Foreign Application Priority Data

Aug. 9, 2011 (JP) ..... 2011-173625

(51) Int. Cl.

| | |
|---|---|
| ***F02B 71/00*** | (2006.01) |
| ***F01L 21/02*** | (2006.01) |
| ***F02B 75/28*** | (2006.01) |
| *F02B 71/04* | (2006.01) |

(Continued)

(52) U.S. Cl.

CPC ..... *F02B 71/00* (2013.01); *F01L 21/02* (2013.01); *F02B 75/28* (2013.01); *F01B 11/08* (2013.01); *F02B 71/04* (2013.01); *F02B 71/045* (2013.01); *F02B 71/06* (2013.01)

(58) Field of Classification Search

CPC ..... F02B 71/00; F02B 71/04; F02B 71/06; F02B 71/045; F01B 11/08

USPC ..... 123/46 A

See application file for complete search history.

(56) References Cited

U.S. PATENT DOCUMENTS

| | | | | |
|---|---|---|---|---|
| 4,066,720 | A * | 1/1978 | Carter | 261/44.3 |
| 6,276,313 | B1 * | 8/2001 | Yang et al. | 123/46 E |

(Continued)

FOREIGN PATENT DOCUMENTS

| | | |
|---|---|---|
| JP | 2003-519328 A | 6/2003 |
| JP | 2007-107475 A | 4/2007 |

(Continued)

OTHER PUBLICATIONS

International Search Report dated Nov. 20, 2012 issued in corresponding application No. PCT/JP2012/070175.

*Primary Examiner* — Lindsay Low
*Assistant Examiner* — Charles Brauch
(74) *Attorney, Agent, or Firm* — Westerman, Hattori, Daniels & Adrian, LLP

(57) ABSTRACT

The free-piston engine 10 includes a combustion space F for combusting an air-fuel mixture, a piston 12 capable of reciprocation between a most-compressed position and a most-expanded position, suction ports 14 for introducing outside air into the combustion space F, and exhaust ports 16 for directing the exhaust gas to the outside. The piston 12 extracts power by moving from the most-compressed position to the most-expanded position by a combustion explosive force and returns from the most-expanded position to the most-compressed position by the actuation of a piston drive device. Furthermore, the piston 12 opens the exhaust port 16 to the combustion space F when the piston 12 has reached the most-expanded position, whereas the piston 12 closes the exhaust ports 16 to the combustion space F when the piston is present in a different position.

20 Claims, 6 Drawing Sheets

(51) Int. Cl.
*F02B 71/06* (2006.01)
*F01B 11/08* (2006.01)

(56) References Cited

U.S. PATENT DOCUMENTS 6,957,632 B1 * 10/2005 Carlson et al. ..... 123/46 R
2001/0029911 A1 10/2001 Yang et al.
2002/0148428 A1 * 10/2002 Pisano et al. ..... 123/190.2
2006/0144041 A1 7/2006 Jacobsen et al.
2010/0162998 A1 * 7/2010 Graef ..... 123/46 SC

FOREIGN PATENT DOCUMENTS

JP 2008-522101 A 6/2008
JP 2008-223657 A 9/2008

* cited by examiner (A)

(B)

(C)

FREE-PISTON ENGINE

TECHNICAL FIELD

The present invention relates to a free-piston engine and, in particular, to a free-piston engine suited to a system in which outside air or an air-fuel mixture of the outside air and a fuel is radially injected toward a given region of a combustion space and the air-fuel mixture is combusted by using a compression action by the collision of the gas in this given region.

BACKGROUND ART

As a conventional engine there is known a free-piston engine in which a crankshaft and the like are not mechanically connected to a piston and the stroke range of the piston is not fixed. As this free-piston engine of Patent Literature 1 proposes a free-piston engine of a structure of a piston valve method in which a scavenging port, a suction port and an exhaust port, which are made on a side wall of a cylinder, are opened and closed by the movement of a piston. The free-piston engine of Patent Literature 1 is intended for incorporation in generating equipment and a pair of pistons is disposed face to face in the cylinder and a combustion space is formed between the opposed surfaces of the pistons.

CITATION LIST

Patent Literature

Patent Literature 1: Japanese Patent Laid-Open No. 2007-107475

SUMMARY OF INVENTION

Technical Problem

However, in the above-described free-piston engine of Patent Literature 1, as with other reciprocating engines, the compression of an air-fuel mixture in the combustion space is performed by only piston motions and there is a limit to the high compression of an air-gas mixture in the combustion space and high outputs of such an extent as required by jet engines and the like are not obtained. The piston of this engine moves after the combustion stroke by the balance adjustment of a gas supplied to the space in the cylinder in front of and behind the piston and the construction is not capable of suiting the high-speed motions of the piston. Therefore, in the above-described free-piston engine of Patent Literature 1, as with conventional engines, the applicable scope of output required is narrow.

In addition, in conventional various engines, it is difficult to satisfy all of high output with high efficiency, noise reduction, and clean exhaust gas. On the other hand, although existing cold nuclear fusion reactors have possibilities of simultaneously satisfying these three, these reactors are very unstable and have not yet been put to practical use.

Furthermore, as conventional engines which give power to movable bodies, such as an automobile and an aircraft, there are jet engines and scramjet engines in addition to reciprocating engines. However, in terms of structures of these engines, applicable speed ranges of movable bodies are limited and there is no engine which can cover each speed range in one engine.

The present invention was made by giving attention to such problems and the object of the present invention is to supply a free-piston engine which can satisfy all of high output with high efficiency, noise reduction, and clean exhaust gas and can cover a wide range of outputs from low-output applications for generation equipment and automobiles to high-output applications for aircraft and rockets.

Solution to Problem

In order to achieve the above-described object, the present invention provides a free-piston engine which mainly includes: a combustion space for combusting an air-fuel mixture of outside air and a fuel; a piston provided so as to be capable of reciprocation between a most-compressed position, which minimizes a volume of the combustion space, and a most-expanded position, which maximizes the volume; a piston drive device which causes the piston to go into action; a suction port which introduces the outside air or a gas composed of the air-fuel mixture into the combustion space; and an exhaust port which directs an exhaust gas generated in the combustion space to the outside. The configuration of this free-piston engine is as follows: the piston extracts power by moving from the most-compressed position to the most-expanded position by an explosive power due to the combustion of the air-fuel mixture in the combustion space and is provided in such a manner as to return from the most-expanded position to the most-compressed position by the actuation of the piston drive device, and at the same time the piston functions as a valve of the exhaust port and opens the exhaust port to the combustion space when the piston has reached the most-expanded position, whereas the piston closes the exhaust port to the combustion space when the piston is present in a different position.

In this specification and the claims, "a given region" refers to a given region away from the outer side of the combustion space, that is, near the center point or center axis of the combustion space away from an engine wall, more specifically an inner wall of the cylinder, where an ejection opening is formed. This given region is a given region which does not undergo displacement even when the moving speed of the piston or the air-fuel ratio is changed and where jets having orientation from each ejection opening collide. The above-described given region is present in the center part of the combustion space away from the engine wall and because main gas compression is performed in this given region, gas compression on the engine wall is scarcely performed. Therefore, losses by heat transfer to the inner wall of the cylinder are small. The above-described given region is present on a micropoint or microsegment which, geometrically, does not come into contact with each surface of the piston or the piston type valve when a jet is supplied from the ejection opening into the combustion space and generation of colliding jet compression is started.

Advantageous Effects of Invention

According to the present invention, when the piston extracts power by moving from the most-compressed position to the most-expanded position, the piston is caused to go into action by an explosive force due to the combustion of the air-fuel mixture in a combustion space, whereas the piston is caused to go into action by the actuation of the piston drive device when the piston is returned from the most-expanded position to the most-compressed position. Therefore, compared to the construction of Patent Literature 1, high-speed reciprocation of the piston becomes possible and it is also possible to meet high-output designs of pistons.

In the present invention, because a piston, a rotary valve or a piston type valve is used in the opening and closing of the suction port and the exhaust port to the combustion space, a valve mechanism, such as a poppet valve which might block jets, becomes unnecessary, making it possible to contribute to miniaturization and weight saving of the whole engine. In addition, it is possible to easily make fine timing adjustments of suction and discharge and it becomes possible to apply the present invention to a wide range of required outputs.

Furthermore, in the combustion space, it is possible to combine the gas compression by the piston with the compression by the collision of the gas ejected from each of the ejection openings of the suction port and the high-pressure compression of the gas in the combustion space can be achieved, with the result that an engine of high-output with high-efficiency can be provided. In addition, the generation of colliding jets in the combustion space results in a decrease in the remaining amount of harmful substances of the exhaust gas, and contributing to making the exhaust gas clean. Also the diffusion of the noise generated by gas expansion in the combustion space during combustion is restricted, and contributing to the reduction of engine noise. Also, the fuel collects in the center part of the combustion space by the multiple generation of colliding jets and it can be ensured that compressed gas and combustion gas do not reach parts other than the above-described given region and part of the above-described piston and the above-described piston type valve, with the result that the high-temperature gas after combustion becomes less apt to be dispersed to outside the combustion space and it is possible to substantially reduce gas cooling losses due to the contact with wall surface parts of the combustion space. Also from this point, it is possible to substantially improve the efficiency and output of the engine. Furthermore, the start of the engine can be smoothly performed.

And the construction in which the piston and the piston type valve are used and the construction in which the pistons and the exhaust ports are disposed symmetrically around the suction ports can be applied also to the combustion method of existing engines. In particular, a combustion method in which gas is compressed by causing the gas to collide in a multiple manner from the ejection opening is combined with the latter construction of symmetric disposition and a prescribed fuel and catalyst are used, whereby it is possible to cause cold nuclear fusion to occur easily.

Furthermore, according to the rotary valve whose formed edge of the hole part is formed to have a non-circular-arc curved line and which has a wall thickness of a region on the outer circumferential side which increases gradually toward the center, it is possible to restrict the separation of the gas passing through the hole part, with the result that it is possible to reduce the noise generated during the introduction of the outside air into the suction valve.

Because of the adoption of a construction in which a suction opening of the suction port is open to a surface part of a moving body, and during the movement of the movable body, it is possible to restrict a change of an airflow along the surface part from a laminar flow to a turbulent flow, it is possible to substantially reduce the air resistance of the movable body due to the generation of a turbulent flow and to substantially reduce energy losses of the whole movable body.

DESCRIPTION OF EMBODIMENTS

Embodiments of the present invention will be described below with reference to the drawings.

First Embodiment

Figure 1:
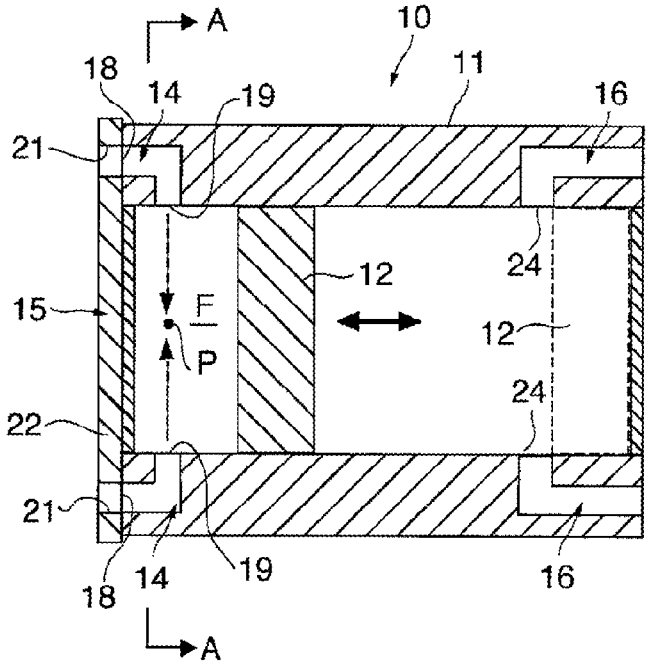
FIG. 1 is a schematic sectional view conceptually showing the construction of a free-piston engine of the first embodiment.

A schematic sectional view conceptually showing the construction of a free-piston engine of the first embodiment is shown in FIG. 1. In this drawing, a free-piston engine 10 includes a cylindrical cylinder 11, a piston 12 which is accommodated in the internal space of the cylinder 11 and provided so as to be movable in a direction along the center axis of the internal space (a horizontal direction in FIG. 1), suction ports 14 which are formed on the left end side of the cylinder 11 in the figure and intended for introducing outside air into the cylinder 11, a rotary valve 15 which is adjacent on the left of the cylinder 11 in the figure and controls the inflow of outside air into the suction ports 14, and exhaust ports 16 which are formed in a part near the right end of the cylinder 11 in the figure and are intended for discharging exhaust gas generated in the cylinder 11 to outside the engine.

The piston 12 is formed in the shape of a column or a disk having an outside diameter almost the same as the inside diameter of the cylinder 11 or a somewhat smaller outside diameter, and a space surrounded by an end surface positioned on the suction ports 14 side (the left end surface in FIG. 1) and an inner wall part of the cylinder 11 constitutes a combustion space F where an air-fuel mixture of the outside air introduced from the suction ports 14 and a fuel combusts. This piston 12 is capable of reciprocation between a most-compressed position which minimizes the volume of the combustion space F and a most-expanded position which maximizes the volume. In this connection, when the piston 12 moves from the most-compressed position in an expansion direction in which the volume of the combustion space F is increased (rightward in the figure), an explosive force by the combustion of the air-fuel mixture in the combustion space F becomes the driving force of the piston 12, and at this time, it is ensured that power, i.e., work is extracted by a power extraction mechanism (omitted in the figure) which connects to the piston 12. This power extraction mechanism is not especially limited, and it is possible to apply various publicly-known mechanisms, such as a mechanism which rotates the motor of a generator, for example, an electromagnetic-effect-using linear generator, which is juxtaposed with the free-piston engine 10, and a mechanical structure for rotating the axle of an automobile, such as a crank. On the other hand, when the piston 12 is moved from the most-expanded position in a direction reverse to the above-described expansion direction, i.e., the piston 12 is moved in the compression direction in which the volume of the combustion space F is reduced (leftward in the figure), the driving force of the piston drive device, which is omitted in the figure, is used. A motor can be mentioned as an example of this piston drive device. However, it is possible to adopt piston drive devices of various constructions so long as they can cause the piston 12 to come into action in the compression direction.

Although omitted in the figure, the cylinder 11 is provided with injection means which injects a fuel to the combustion space F, and it is ensured that an air-fuel mixture of the fuel from this injection means and the outside air introduced from the suction ports 14 is generated in the combustion space F. In this connection, it is possible to adopt a configuration in which the above-described injection means is provided midway in the suction ports 14 and an air-fuel mixture is supplied from the suction ports 14 to the combustion space F.

The suction port 14 is a flow path extending from a suction opening 18 which is open to the left end surface of the cylinder 11 in FIG. 1 to an ejection opening 19 which is open to the combustion space F and, as shown in FIG. 2(A), the suction port 14 is formed in a plurality of places (in eight places in this embodiment) at equal intervals along the circumferential direction of the cylinder 11. The ejection openings 19 mutually have the same shape and are provided in places in which the ejection openings 19 are always open to the interior of the cylinder 11 regardless of the movement of the piston 12. Each of the ejection openings 19 is provided in such a manner as to be capable of forming jets by ejecting outside air from the positions at substantially equal intervals in the circumferential direction of the inner wall of the cylinder 11 toward a given region of the combustion space F, i.e., a collision part P in the middle of the interior. In this collision part P, it is ensured that an air-fuel mixture is compressed by causing jets of the outside air ejected from each of the ejection openings 19 to collide. In this connection, it is preferred that the flow path of the suction port 14 near the ejection opening 19 be provided with a part which extends linearly, a straight-pipe part in order that the ejection direction of jets due to the Coanda effect is not made unstable.

Figure 2:
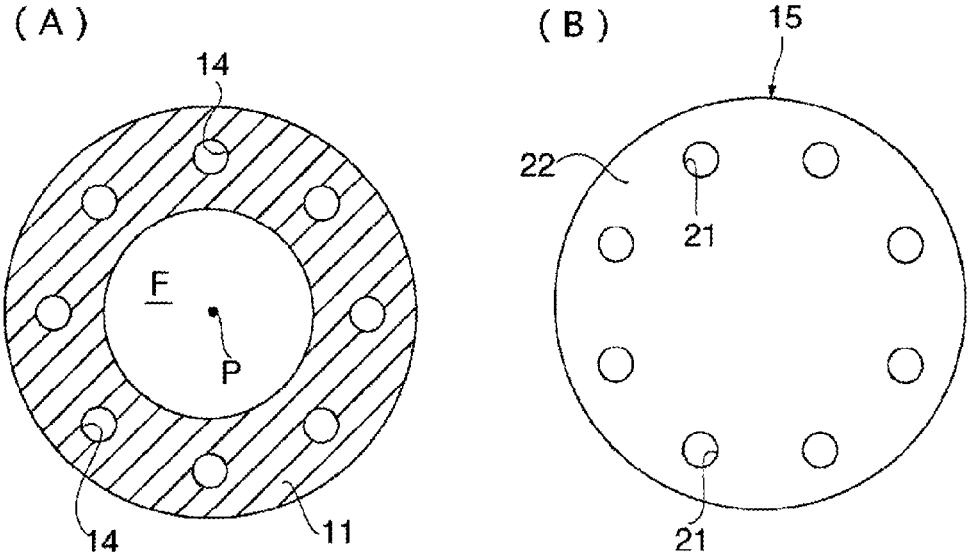
FIG. 2 (A) of FIG. 2 is a schematic sectional view of the above-described free-piston engine in the direction along the A-A line of FIG. 1, and (B) of FIG. 2 is a front view conceptually showing the rotary valve.

The rotary valve 15 has the shape of a disk, is rotatably supported by a cylinder 11 around the center axis of the combustion space F, and is capable of forward and reverse rotations at a prescribed timing by the driving of a rotation device, which is omitted in the figure. That is, the rotary valve 15 is capable of being switched by the rotary action thereof between an open position, which permits the taking-in of the outside air from the suction ports 14 into the combustion space F, and a closed position, which controls the taking-in of the outside air from the suction ports 14 into the combustion space F. As shown in FIG. 2 (B), this rotary valve 15 is composed of hole parts 21 in the shape of a round hole formed in a plurality of places (eight places in this embodiment) near the outer edge at circumferential equal intervals and a surface part 22 except the hole parts 21. Each of the hole parts 21 is formed in a position and with a size which permit mutual communication facing each of the suction openings 18 of the suction ports 14. The surface part 22 is formed in such a manner as to close all of the suction openings 18 when the surface part 22 faces each of the suction openings 18 by the rotation of the rotary valve 15. In this embodiment, it is ensured that when the rotary valve 15 is in the closed position, the suction openings 18 are completely closed to the external space. However, the suction openings 18 may be brought into a condition slightly open to the external space.

The exhaust port 16 is formed in a plurality of places (eight places in this embodiment) at equal intervals along the circumferential direction of the cylinder 11, and each of the exhaust ports 16 is provided with an exhaust opening 24 which is open to the interior of the cylinder 11 in a position near the right side in FIG. 1. It is ensured that the exhaust openings 24 become open to the combustion space F when the piston 12 has reached the most-expanded position indicated by a broken line in the figure, and at that time, the exhaust gas generated in the combustion space F becomes capable of being discharged from the exhaust ports 16 to the outside of the free-piston engine 10. When the piston 12 is present in another place, it is ensured that the flow of the gas between the combustion space F and the exhaust openings 24 is blocked by the piston 12. Therefore, the piston 12 functions also as a valve of the exhaust ports 16.

Figure 3:
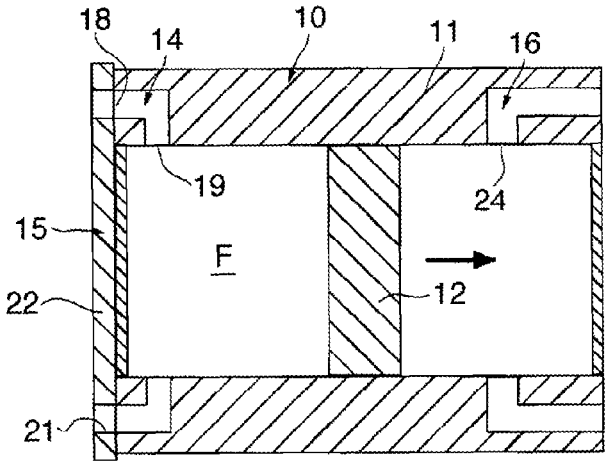
FIGS. 3 (A), (B) and (C) of FIG. 3 are schematic sectional views to explain actions of the free-piston engine from the condition of FIG. 1.
Figure 3:
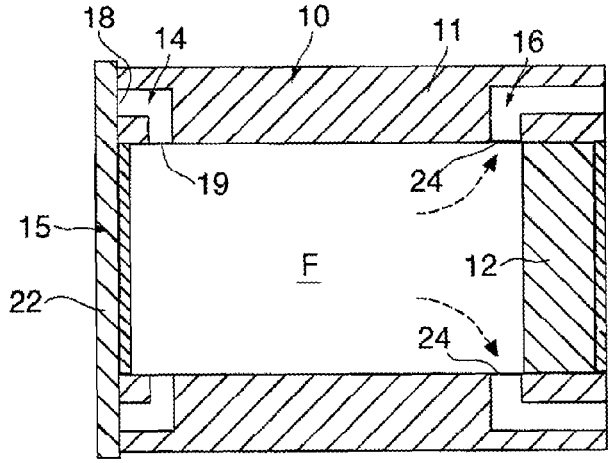
Figure 3:
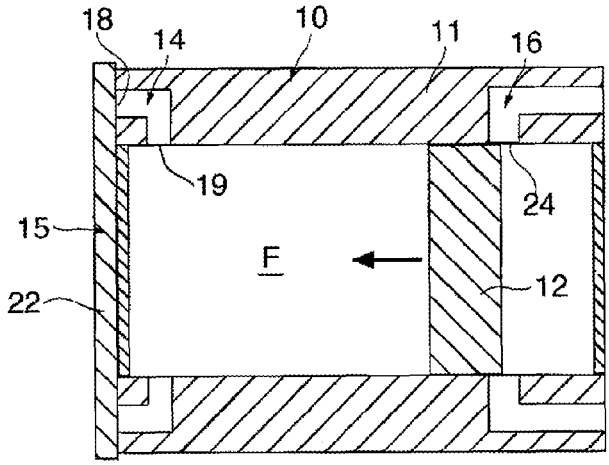

Next, the action of the free-piston engine 10 will be described with the aid of FIGS. 1 and 3.

First, as shown in FIG. 1, the rotary valve 15 is brought into the open position, outside air is introduced from the outside of the free-piston engine 10 into the suction ports 14, and the outside air is supplied to the combustion space F. On this occasion, the outside air supplied to the combustion space F is radially injected as a jet from each of the ejection openings 19 toward the collision part P, collides in the collision part P while being mixed with a fuel, and is compressed. At this time, colliding jets are generated around the collision part P. At the same time with this, the piston 12 moves in the above-described compression direction (leftward in the figure) by the driving of the piston drive device (omitted in the figure) and the volume of the combustion space F decreases, with the result that the air-fuel mixture is further compressed. At this time, the piston 12 becomes present between the ejection openings 19 of the suction ports 14 and the exhaust openings 24 of the exhaust ports 16, and the flow of the gas between the combustion space F and the exhaust openings 24 is blocked by this piston 12.

And when the air-fuel mixture of the combustion space F combusts and explodes at the point of time when the piston 12 is present in the most-compressed position or a position near this most-compressed position, as shown in FIG. 3(A), the piston 12 moves in the above-described expansion direction (rightward in the figure) and power is extracted by the power extraction mechanism (omitted in the figure). A method of combusting and exploding an air-fuel mixture is not specially limited. In addition to techniques using ignition means, which are exemplified by spark ignition using a plug and the like and laser ignition and the like, it is also possible to adopt a self-ignition method which is capable of ignition and explosion during compression because of the characteristics of a fuel without using the ignition means.

Furthermore, as shown in FIG. 3(B), when the piston 12 moves to the most-expanded position which is on the right side of the exhaust openings 24 in the figure, the combustion space F is brought into communication with the exhaust openings 24 and the exhaust gas generated in the combustion space F is discharged from the exhaust openings 24 to the exhaust ports 16. On this occasion, the rotary valve 15 is brought into the closed position and the introduction of the outside air from the suction ports 14 into the combustion space F is blocked. At this time, because of the closing of the rotary valve 15 to the combustion space F and the opening of the exhaust openings 24, a negative pressure is generated in a region of the interior of the cylinder 11 on the ejection openings 19 side.

And as shown in FIG. 3(C), with the rotary valve 15 kept in the closed position, the piston 12 moves in the above-described compression direction (leftward in the figure) by the driving of the piston drive device (omitted in the figure) and the gas of the combustion space F is compressed, with the flow of the gas from the combustion space F to the exhaust openings 24 blocked. And when the piston 12 has reached a prescribed position and the combustion space F has come to a compressed condition to a certain degree, the rotary valve 15 is again brought into the open position and outside air is brought into the combustion space F using the negative pressure which has already been generated in the combustion space F. With the foregoing as one cycle, the above-described actions are repeated.

The action timing of the piston 12 by the piston drive device (omitted in the figure) and the timing of opening and closing of the rotary valve 15 by the driving of the rotary device (omitted in the figure) are controlled by a controller which is not shown in the figure on the basis of measurement results of various kinds of sensors, which are not shown in the figure, such as the position of the piston 12 and the pressure condition of the combustion space F.

Therefore, according to the first embodiment as described above, the opening and closing action for the switching between the open position and closed position of the rotary valve 15 is performed repeatedly, the outside air is radially ejected intermittently as a jet from each of the ejection openings 19 toward the collision space P, and gas collision occurs intermittently in a multiple manner in the collision part P, with the result that pulse-like colliding jets are generated in the combustion space F. When the rotary valve 15 is switched from the open position to the closed position, it is possible to bring the combustion space F to a negative pressure condition by temporarily lowering the pressure of the combustion space F, and when the rotary valve 15 has been switched from the closed position to the open position, the taking-in of the outside air from each of the ejection openings 19 is accelerated and hence it is possible to enhance the efficiency of suction to the combustion space F. Furthermore, because the compression of the air-fuel mixture in the combustion space F is performed by both the colliding jets and the movement of the piston 12, a high compression effect is obtained, it is possible to shorten the stroke of the piston 12, and it is possible to cause the piston 12 to perform reciprocation at a higher frequency than before. Because a valve mechanism such as a reciprocating engine becomes unnecessary, it is possible to vary the compression ratio, the expansion ratio, the suction and discharge periods, and the number of revolutions of the engine infinitely. Furthermore, during the combustion and explosion of the air-fuel mixture in the collision part P, it is possible to seal in the noise in the combustion space F without diffusion by a high-speed airflow generated around the collision part P and hence it is possible to reduce the noise compared to the case where conventional engines are used. Also, by the generation of colliding jets it is possible to combust harmful substances in the exhaust gas efficiently and the remaining amount of the harmful substances decreases. Thus it is possible to make exhaust gas clean.

As is apparent from the foregoing, the free-piston engine 10 of this embodiment has a structure suited to the compression method of an air-fuel mixture by colliding jets, and compared to conventional engines it is possible to achieve a high efficiency and a high output ratio. At the same time, this free-piston engine 10 produces the effects that it is possible to meet a wide range of output requests and to make contribution to reducing engine noise and making exhaust gas clean.

For the shape of the suction opening 18 and the rotary valve 15, giving a smooth non-linear-arc curve to the formed edge of the suction opening 18 and the hole part 21 enables the noise by the separation of the outside air to be reduced substantially during switching between the open position and closed position of the rotary valve 15. Noise can be reduced similarly by increasing the wall thickness of the surface part 22 present around the hole parts 21 with increasing distance from the hole parts 21 of the rotary valve 15.

Next, other embodiments of the present invention will be described. In the following description, component parts which are the same as in the first embodiment or equivalent ones bear like numerals and descriptions of these component parts are omitted or simplified.

Second Embodiment

A schematic sectional view conceptually showing the construction of a free-piston engine 30 of the second embodiment is shown in FIG. 4(A). In this figure, the free-piston engine 30 of this embodiment is characterized in that a piston type valve 32 is provided in the cylinder 11 in place of the rotary valve 15 of the free-piston engine 10 of the first embodiment.

The piston type valve 32 is formed in the shape of a column or a disk having an outside diameter almost the same as the inside diameter of the cylinder 11 or a somewhat smaller outside diameter, and is disposed facing the piston 12 leftward therefrom in FIG. 4(A). The combustion space F in this embodiment is formed in a space surrounded by the piston 12 in the cylinder 11 and the piston type valve 32. This piston type valve 32 is capable of moving in the same direction as the action direction of the piston 12, i.e., in the right and left directions in the figure by a valve drive device composed of a motor, which is not shown in the figure. The above-described power extraction mechanism may be connected also to the piston type valve 32 so that work can be extracted also by the action of the piston type valve 32.

Figure 4:
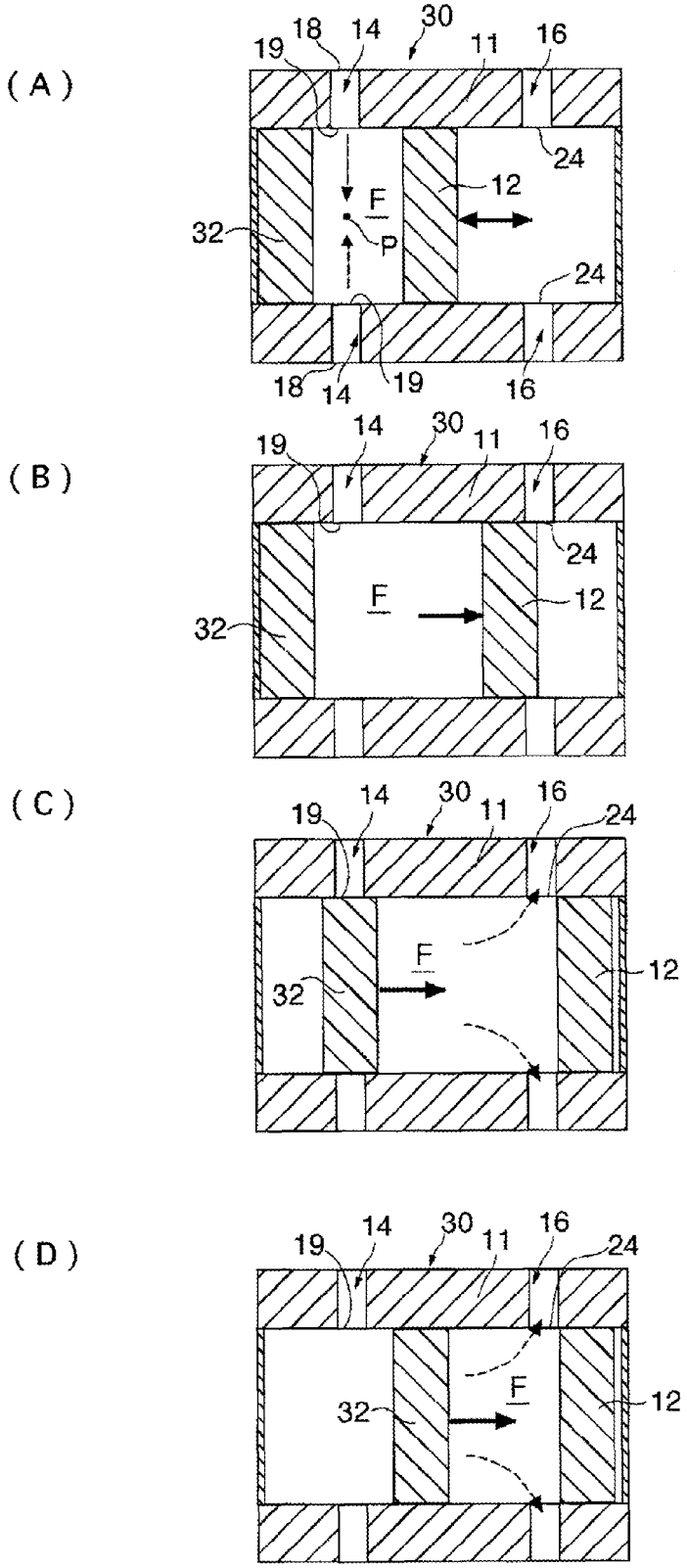
FIG. 4 (A) of FIG. 4 is a schematic sectional view conceptually showing the construction of a free-piston engine of the second embodiment, and (B), (C) and (D) of FIG. 4 are schematic sectional views to explain actions of the free-piston engine from the condition to the exhaust stroke from the condition of (A).

Next, the action of the free-piston engine 30 will be described with the aid of FIG. 4.

First, as shown in FIG. 4(A), the piston type valve 32 is fixed in the initial position on the left end of the figure in such a manner as to be incapable of movement and the piston 12 is disposed so that outside air can be introduced from the ejection openings 19 into the combustion space F. On this occasion, in the same manner as in the first embodiment, the outside air in a jet condition supplied to the combustion space F collides in the collision place P while being mixed with a fuel, and the air-fuel mixture is compressed while generating a colliding jet. At the same time with this, the piston 12 moves in the above-described compression direction (leftward in the figure) by the driving of the piston drive device (omitted in the figure) and the air-fuel mixture in the combustion space F is further compressed. At this time, the piston 12 is present between the ejection openings 19 and the exhaust openings 24 and the flow of the gas between the combustion space F and the exhaust openings 24 is blocked by the piston 12.

And the air-fuel mixture of the combustion space F combusts and explodes at the point of time when the piston 12 is present in the most-compressed position or a position near this most-compressed position, as shown in FIG. 4(B), the piston 12 moves in the above-described expansion direction (rightward in the figure), and power is extracted. On this occasion, the piston type valve 32 is maintained in the above-described initial position in a fixed condition.

Figure 5:
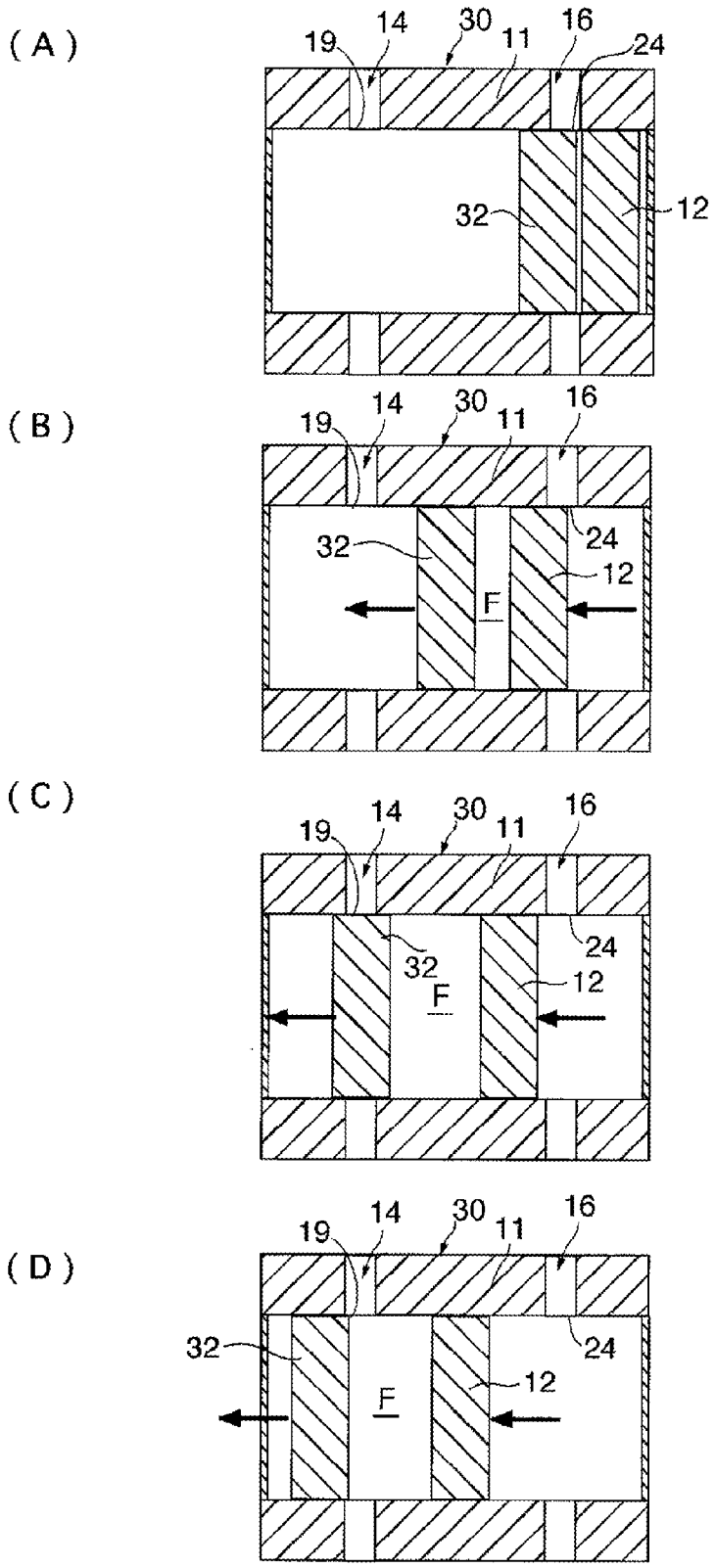
FIGS. 5 (A), (B), (C) and (D) of FIG. 5 are schematic sectional views to explain actions of the free-piston engine to the suction stroke from the condition of FIG. 4 (D).

Next, as shown in FIG. 4(C), when the piston 12 moves to the most-expanded position which is on the right side of the exhaust openings 24 in the figure, the combustion space F is brought into communication with the exhaust openings 24 and the exhaust gas generated in the combustion space F is discharged from the exhaust openings 24 to the exhaust ports 16. At this time, the piston type valve 32 moves by the driving of the valve drive device (omitted in the figure) in such a manner as to approach the piston 12 while narrowing the distance to the piston 12. As a result of this, the volume of the combustion space F between the piston 12 and the piston type valve 32 decreases gradually and the exhaust gas generated in the combustion space F comes to be easily discharged into the exhaust ports 16. At this time, as shown in FIG. 4(D), the piston type valve 32 is present between the ejection openings 19 and the exhaust openings 24, and the introduction of the outside air from the ejection openings 19 into the combustion space F is blocked by the piston type valve 32. As shown in FIG. 5(A), the piston type valve 32 moves in such a manner as to come into substantial contact with the piston 12 in a position near the exhaust openings 24 and reduces the volume of the combustion space F to almost zero, as a result of which the exhaust gas in the combustion space F is forcedly discharged from the exhaust openings 24 into the exhaust ports 16. It is not always necessary that the piston type valve 32 move to the position in the figure, i.e., a position where the exhaust opening 24 is almost completely closed.

And by the driving of the piston drive device and the valve drive device, which are not shown in the figure, as shown in FIG. 5(B), both the piston 12 and the piston type valve 32 move in the direction of the ejection openings 19 (leftward in the figure) while increasing the mutual distance. At this time, as shown in FIG. 5(C), the combustion space F is closed when the piston 12 and the piston type valve 32 move to the place where the flow of the gas between the ejection openings 19 and the exhaust openings 24 and the combustion space F is blocked. When in this condition, both the piston 12 and the piston type valve 32 move in the direction of the ejection openings 19 (leftward in the figure) while increasing mutual distance, the volume of the combustion space F which has been closed expands and a negative pressure is generated in the combustion space F. And as shown in FIG. 5(D) when the piston type valve 32 returns to a position on the left side of the ejection openings 19 in the figure, the outside air is introduced from the ejection openings 19 into the combustion space F using the negative pressure of the combustion space F. With the foregoing as one cycle, the above-described actions are repeated. In this connection, during the generation of a colliding jet, the piston type valve 32 is a little moved in the direction of the piston 12, whereby the colliding jet is drawn into the negative pressure region of the combustion space F present near the piston 12 and it is possible to enhance the vibration reducing effect of the piston 12 during combustion.

The piston 12 and the piston type valve 32 go into action asymmetrically so that a negative pressure can be generated in the combustion space F after gas discharge. The action timing of the piston 12 and the piston type valve 32 is controlled by a controller, which is not shown in the figure, on the basis of measurement results of various kinds of sensors, which are not shown in the figure, such as the position of the piston 12 and the pressure condition of the combustion space F.

Therefore, according to this second embodiment, compared to the first embodiment, the configuration does not require the rotary valve 15 and hence the action noise which might be caused by the opening and closing action of the rotary valve 15 is not generated and it is possible to further enhance the overall noise reducing effect. Furthermore, the rotary mechanism and the like of the rotary valve 15 become unnecessary and it is possible to achieve further miniaturization and weight saving of the whole engine and it is possible to improve the endurance of the engine.

The discharge of exhaust gas to the exhaust port 16 is accelerated by the movement of the piston type valve 32, gas discharge can be performed more efficiently, and it is possible to further accelerate higher efficiency and higher outputs of the engine.

The free-piston engine 30 of the second embodiment may be a type in which a colliding jet is not generated in the combustion space F and outside air is introduced from the ejection openings 19 into the combustion space F and an air-fuel mixture of the outside air and a fuel is caused to combust and explode. In this case, the ejection opening 19 and exhaust opening 24 which are open to the interior of the cylinder 11 may be provided only in one place, respectively.

In the above-described controller, it can also be ensured that when the piston 12 and the piston type valve 32 move after the discharge of exhaust gas, the distance between the two is made adjustable, whereby the desired negative pressure is obtained. For example, it is also possible to control the action of the piston drive device and the valve drive device by reducing the a negative pressure to zero immediately after the start of the engine so that this negative pressure increases gradually.

Figure 6:
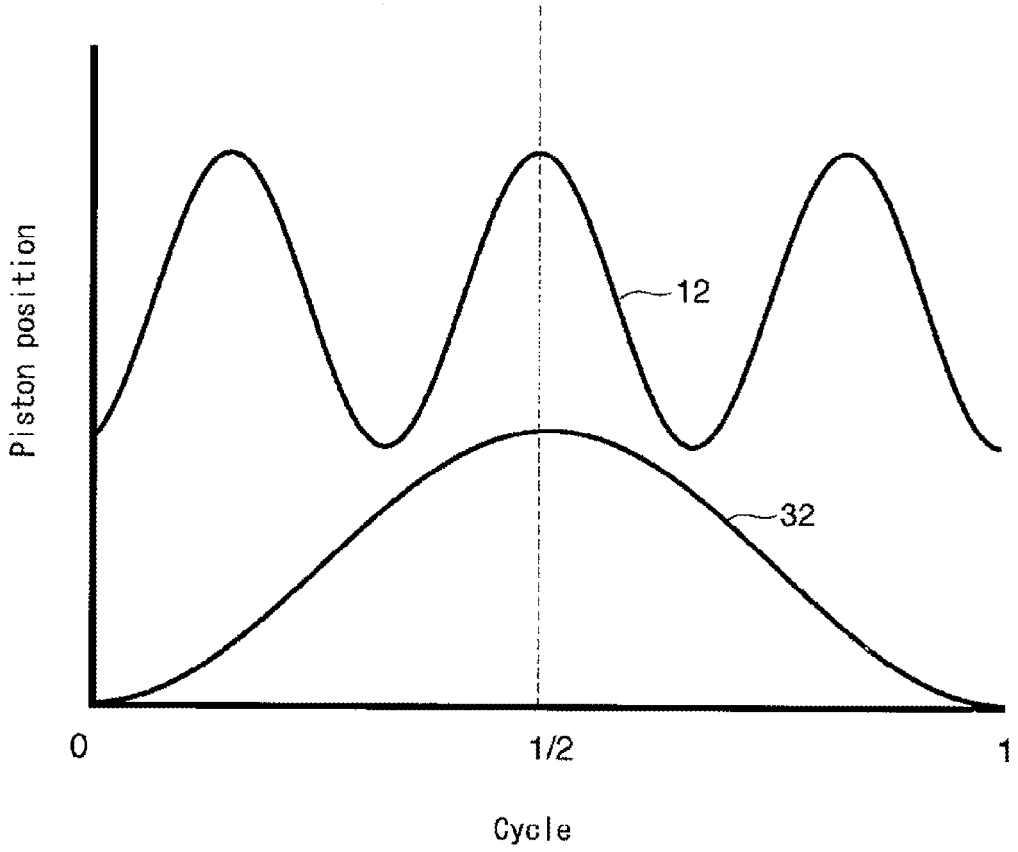
FIG. 6 is a graph to explain actions of the piston and the piston type valve in one cycle.

Furthermore, it is possible to mechanically configure the piston 12 and the piston type valve 32 in such a manner that during a one-cycle action of the piston type valve 32, the piston 12 goes into action in a cycle of a whole number of times (for example, three times are preferable; see FIG. 6). In this case, for the movement of the piston 12 and the piston type valve 32 and power extraction, by an action of a simple sine wave through the use of only a mechanical structure such as a crank, it is possible to realize performance equal to or more than the performance obtained in the action of this embodiment. In this connection, this action may be performed by the control by the controller. According to this, it is possible to make the moving range of the piston 12 smaller and to make the stroke of the piston 12 lower. In FIG. 6, the upper curve indicates the piston position in one cycle in the piston 12, and the lower curve indicates the piston position in one cycle in the piston type valve 32. For the piston positions in the figure, the lower end in the figure corresponds to the position of the left end in the cylinder 11 and the upper end in the figure corresponds to the position of the right end in the cylinder 11. Inversely, it is also possible to perform configuration in such a manner that during a one-cycle action of the piston 12, the piston type valve 32 go into action in a cycle of a whole number of times.

It is recommended that the exhaust openings 24 be provided in the same number as the ejection openings 19, that each exhaust openings 24 be disposed to correspond to the axis line direction of the combustion space F with respect to each ejection openings 19, that is, the positions of each ejection openings 19 and each exhaust openings 24 in the circumferential position of the combustion space F be caused to coincide, and that EGR ports which connect and communicate with each other be provided between each suction ports 14 and each exhaust ports 16 so that part of the exhaust gas discharged from the exhaust openings 24 can be ejected together with the outside air from the corresponding ejection openings 19. According to this configuration, it is possible to perform the compression and combustion in the combustion space F in a more stable manner. That is, if a disturbance occurs on the upstream side of the gas ejected from part of the ejection openings 19, some jets from the ejection openings 19 are strong and some jets are weak and a jet stream after jet collision is pushed in the direction of the ejection openings 19 of weak jet. However, as a result of this, the amount of exhaust gas to the exhaust openings 24 corresponding to these ejection openings 19 in the circumferential direction increases. Therefore, in the next cycle, the amount of jet from these ejection openings 19 increases and the jet stream which has undergone displacement is directed to a normal position. It is also possible to provide means by which the combustion condition of the combustion space F, including the amount of jet from each of the ejection openings 19, is detected through the use of sensors and the like and the ejection amounts of exhaust gas from each of the ejection openings 19 are electromagnetically controlled on the basis of these detected values. Examples of this means include a solenoid valve provided in an EGR port and a controller which controls the solenoid valve.

Furthermore, it is also possible to provide each ejection openings 19 in such a manner as to be capable of supplying the jet to the combustion space F in a direction in which the collision part P is formed near the exhaust ports 16, thereby enabling the stroke of the piston type valve 32 to be shortened.

Third Embodiment

A schematic sectional view conceptually showing the construction of a free-piston engine of the third embodiment is shown in FIG. 7(A). In this figure, compared to the first embodiment, the free-piston engine 40 of this embodiment is characterized in that without the installation of the rotary valve 15, the piston 12 and the exhaust ports 16 are provided each in a pair in a direction along the center axis of the combustion space F and are disposed symmetrically horizontally in the figure around the suction ports 14.

The pair of pistons 12, 12 in this case is capable of coming into action symmetrically in FIG. 7(A). Although the suction ports 14 are not especially limited, the suction ports 14 are formed in a plurality of sets around the circumference of the cylinder 11 in the circumferential direction of the cylinder 11, three rows being one set, and is formed in such a manner that around the suction ports 14 present in the center, the suction ports 14, 14 in other two places are horizontally symmetric in the figure. In this connection, each of the ejection openings 19 of the suction ports 14 in three rows is provided to as to be capable of radially ejecting outside air toward the collision part P in the same manner as in each of the above-described embodiments, and in the collision part P, an air-fuel mixture in a jet condition collides in a more multiple manner than in each of the above-described embodiments, and the air-fuel mixture can be compressed by generating colliding jets. Furthermore, the exhaust ports 16 are disposed symmetrically on both left and right end sides in the figure.

Figure 7:
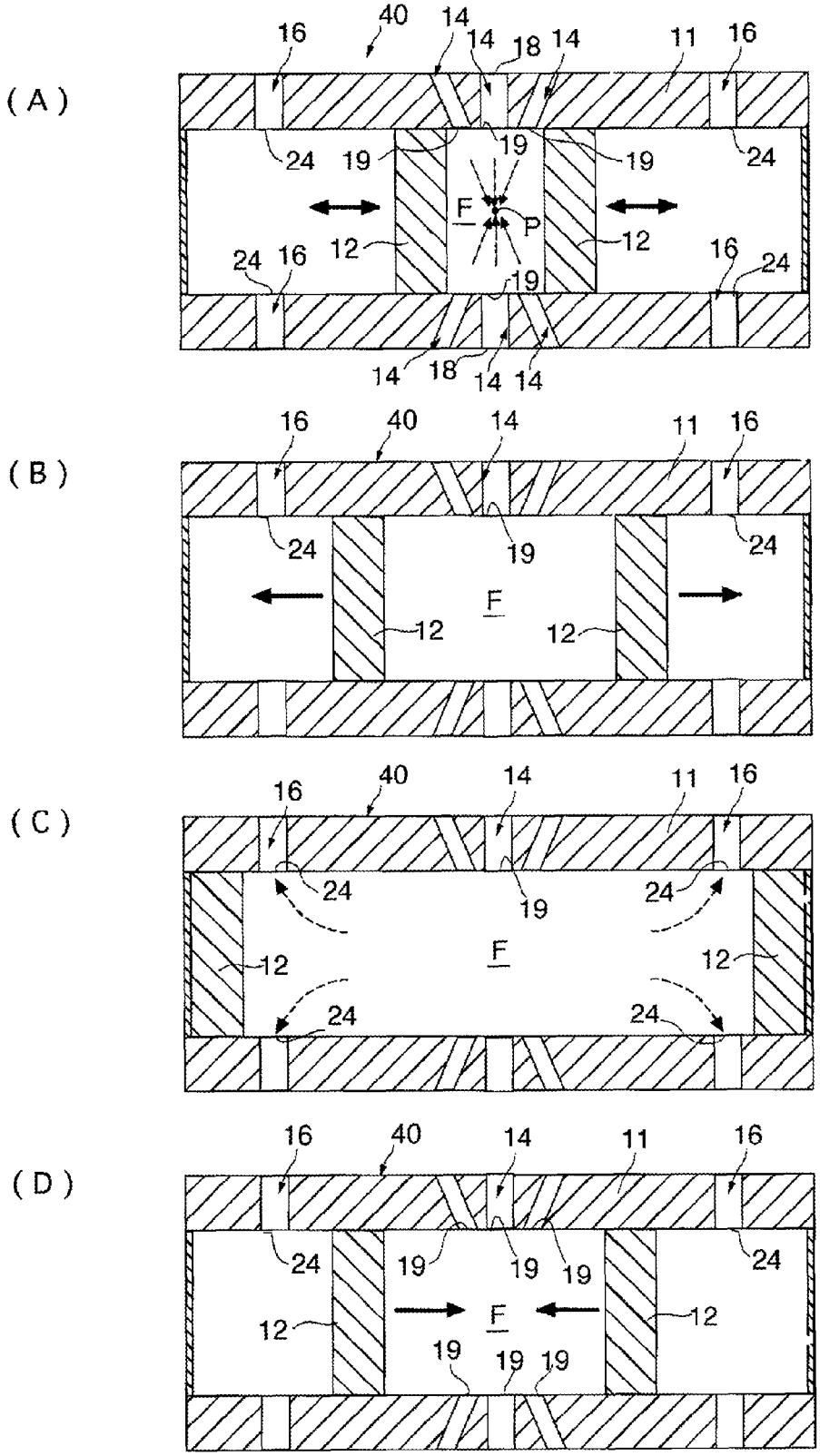
FIG. 7 (A) of FIG. 7 is a schematic sectional view conceptually showing the construction of a free-piston engine of the third embodiment, and (B), (C) and (D) of FIG. 7 are schematic sectional views to explain actions of the free-piston engine from the condition of (A).

Next, the action of the free-piston engine 40 will be described with the aid of FIG. 7.

First, as shown in FIG. 7(A), the right and left pistons 12, 12 in the figure are disposed with a given gap to form the combustion space F therebetween, and are disposed in such a manner that all of the ejection openings 19 of each of the suction ports 14 are open to the combustion space F. In this condition, outside air is introduced into each of the suction ports 14 and this outside air is supplied to the combustion space F through each of the ejection openings 19. On this occasion, the outside air supplied to the combustion space F is radially ejected toward the collision part P while being mixed with a fuel, generating multiple colliding jets and compressing the air-fuel mixture. At the same time with this, each of the pistons 12, 12 moves by the driving of a piston drive device (omitted in the figure) in a direction in which the two approach each other and the volume of the combustion space F decreases, with the result that the air-fuel mixture in the combustion space F is further compressed. At this time, it is ensured that each of the pistons 12, 12 is present between the ejection openings 19 and the exhaust openings 24 and the flow of gas between the combustion space F and each of the exhaust openings 24, 24 is blocked by each of the pistons 12, 12.

And at the point of time when each of the pistons 12, 12 is present in the most-compressed position, where the two approach each other most, or a position near the most-compressed position, the air-fuel mixture of the combustion space F combusts and explodes, with the result that as shown in FIG. 7(B), by the explosive force, each of the pistons 12, 12 moves in directions in which the two move away from each other, and power is extracted from each of the pistons 12, 12.

Furthermore, as shown in FIG. 7(C), when each of the pistons 12, 12 moves to the most-expanded position on the outer side of each of the exhaust openings 24, 24 in the figure, the combustion space F communicates with the exhaust openings 24 and the exhaust gas generated in the combustion space F is discharged through the exhaust openings 24 into the exhaust ports 16. On this occasion, a negative pressure is generated in the combustion space F between the pistons 12, 12.

Next, as shown in FIG. 7(D), each of the pistons 12, 12 moves in directions in which the two approach each other, with a piston drive device, which is not shown in the figure, as power. At this time, each of the pistons 12, 12 is present between the combustion space F and the exhaust openings 24, and the flow of gas between the combustion space F and the exhaust openings 24 is blocked by the presence of each of the pistons 12, 12. Also on this occasion, outside air is introduced from each of the ejection openings 19 into the combustion space F using the negative pressure of the combustion space F which has already been generated, and each of the pistons 12, 12 further moves in the directions in which the two approach each other, whereby the air-fuel mixture of the combustion space F is compressed. With the foregoing as one cycle, the above-described actions are repeated.

As in each of the above-described embodiments, the action timing of the pistons 12, 12 by a piston drive device not shown in the figure, is controlled by a controller which is not shown.

According to this third embodiment, it is possible to further enhance the effect of each of the above-described embodiments.

It is possible to adopt the following examples of variation in the configuration of each of the above-described embodiments.

It is recommendable to form the suction opening 18 of the suction port 14 in such a manner that the suction opening 18 is open to the surface part of a movable body where the free-piston engine is mounted. As a result of this, in the process of the movement of this movable body, part of the air which passes along the surface part is introduced from the suction opening 18 into the suction port 14 and the flow of air along the surface part is prevented from changing from a laminar flow to a turbulent flow midway in this surface part. Therefore, it is possible to substantially reduce the air resistance caused of this change.

Besides, a hydrocarbon fuel, hydrogen or heavy hydrogen is used as the fuel, and one or more catalysts composed of platinum, nickel, palladium, lithium or sulfur and atomic molecules having an atomic number close to the atomic number thereof are used in combination, whereby it is possible to generate great energy by cold nuclear fusion in the combustion space F. On this occasion, it is recommended that the particle diameter of a catalyst be not more than 10 nm. In the case where a hydrocarbon fuel is used, it is preferable that the local mixture ratio provide an air-fuel mixture whose fuel is richer than at the theoretical mixture ratio with stoichiometric condition so that hydrogen is generated after combustion. Furthermore, the above-described catalyst may be formed in the middle part of the surface on the combustion space F side in the piston 12 by being applied in thin film condition without being mixed with the fuel.

And the ejection openings 19 are preferably disposed axially symmetrically with respect to the center axis of the combustion space F and are provided in three or more places in the circumferential direction of the cylinder 11. As a result of this, it becomes possible to positively concentrate jets from each ejection openings 19 on the collision place P and hence the compression effect by colliding jets can be enhanced. By giving the formed edge of the ejection opening 19 a shape of a noncircular curved line, when the opening area thereof increases and decreases with time during the opening and closing the ejection opening 19, it is possible to vary the ratio of change with time in the jet flow rate from the ejection opening 19 and hence it becomes possible to further reduce noise and vibration.

Furthermore, immediately before the combustion in the combustion space F, it is recommended that the piston 12 be moved in a direction from the above-described most-compressed position to the most-expanded position and/or the piston type valve 32 be moved from the above-described initial position in the direction of the exhaust ports 16. As a result of this, power is extracted to a maximum degree and it is possible to optimize the thermal efficiency.

And in the above-described controller, it is also possible to perform control in such a manner as to permit switching between a first mode, in which combustion is performed by only the compression of the piston 12 without generating a colliding jet in the combustion space F, and a second mode, in which combustion is performed by generating the colliding jet in the combustion space F. In the first mode, uniform compression is performed in the combustion space F like mechanical compression using a conventional reciprocating engine, whereas in the second mode, as described above, compression is mainly performed near the collision part P in the middle of the interior of the combustion space F.

Furthermore, it is also possible to adopt a configuration which is such that in the combustion space F, exhaust gas is introduced together with the gas from the ejection openings 19 and this exhaust gas is caused to be capable of colliding against the colliding jet. As a result of this, the compression ratio is increased and detonation is restricted by an increase in the air-fuel ratio and unnecessary vibrations of the piston 12 can be reduced. For the introduction of the exhaust gas into the combustion space F in this case, it is possible to adopt various configurations so long as that the exhaust gas can be introduced together with the gas from the ejection openings 19, such as a configuration in which this introduction is performed by connecting the exhaust port 16 to the suction port 14 and a configuration in which the action of the piston 12 is controlled by the controller and during the introduction of the gas from the ejection openings 19, the exhaust gas is introduced from the exhaust openings 24.

And it is also possible to provide means by which only outside air not containing a fuel is introduced into the combustion space F and a stop cycle in which combustion is not performed is created. As a result of this, it is possible to easily perform power control of an engine from which given power is not required, such as an engine for automobile.

Furthermore, it is also possible to adopt a configuration in which a supercharger or a turbocharger is provided on the upstream side of the suction ports 14, the pressure of outside air (air) introduced into the suction ports 14 is increased, and even in the case where the pressure in the combustion space F is not less than atmospheric pressure, colliding jets are generated by feeding a plurality of jets into the combustion space F. As a result of this, the compression ratio increases further, ignition performance is improved, and more work can be extracted.

And according to each of the above-described embodiments, collision of a plurality of jets is repeated in the collision part P and pulse-like colliding jets are generated, whereby it is possible to generate plasma flows. It is also possible to perform power generation by the electromagnetic effect using plasma flows. Specifically, a magnet is disposed near the collision part P and power is generated by the MHD (magneto hydro dynamics) effect by plasma flows. As a result of this, power generation becomes possible in the case where the piston 12 and the piston type valve 32 are not in action and even on the occasion of slow action, and part of airflow energy in the combustion space F can be used in power generation. The airflow speed decreases and efficient energy generation becomes possible. It is also possible to use this power generation as the power source of the above-described piston drive device, valve drive device, supercharger or turbocharger and the like.

The configuration of each part of devices in the present invention is not limited to the examples of configuration shown in the figures, and various changes are possible so long as such changes produce substantially similar actions. For example, it is possible to give smoothly curved shapes to the suction port 14 and the exhaust port 16.

INDUSTRIAL APPLICABILITY

The present invention is suitable as the power generation source of a motor and an automobile. In addition, the present invention can be used as the thrust force generation source of aircraft, rockets and the like and can be used as the power of a wide range of devices.

REFERENCE SIGNS LIST

10 Free-piston engine
12 Piston
14 Suction port
15 Rotary valve
16 Exhaust port
18 Suction opening
19 Ejection opening
21 Hole part
22 Surface part
24 Exhaust opening
30 Free-piston engine
32 Piston type valve
40 Free-piston engine
F Combustion space
P Collision part

The invention claimed is:

1. A free-piston engine, comprising:

a combustion space for combusting an air-fuel mixture of outside air and a fuel;

a piston provided in such a manner as to be capable of reciprocation between a most-compressed position, which minimizes a volume of the combustion space, and a most-expanded position, which maximizes the volume;

a piston drive device which causes the piston to go into action;

a suction port which introduces the outside air or a gas composed of the air-fuel mixture into the combustion space;

an exhaust port which directs an exhaust gas generated in the combustion space to outside of the free-piston engine;

a piston type valve which makes the suction port capable of opening and closing by moving along a center axis direction of the combustion space; and a valve drive device which causes the piston type valve to go into action, wherein the piston extracts power by moving from the most-compressed position to the most-expanded position by an explosive force due to the combustion of the air-fuel mixture in the combustion space and is provided in such a manner as to return from the most-expanded position to the most-compressed position by the actuation of the piston drive device, and at the same time the piston functions as a valve of the exhaust port and is disposed in such a manner as to open the exhaust port to the combustion space when the piston has reached the most-expanded position, whereas the piston closes the exhaust port to the combustion space when the piston is present in a different position, and wherein the piston type valve is disposed face to face with the piston, forms the combustion space in a space surrounded by the piston and the piston type valve, moves by the actuation of the valve drive device after combustion in the combustion space from an initial position where the suction port opens to the combustion space in a direction toward the piston to a position where the suction port is closed to the combustion space and promotes discharge of the exhaust gas to the exhaust port, and returns to the initial position after finish of the discharge of the exhaust gas.

2. The free-piston engine according to claim 1, wherein the piston drive device and the valve drive device are provided in such a manner that the piston and the piston type valve can go into action asymmetrically and are provided so as to be capable of generating a negative pressure in the combustion space before introduction of the gas while increasing a distance between the piston and the piston type valve, with the combustion space closed by the piston and the piston type valve, after finish of the discharge of the exhaust gas.

3. The free-piston engine according to claim 1, wherein the suction port is provided with a plurality of ejection openings each formed so as to be capable of ejecting the gas toward a given region positioned in a middle of the interior of the combustion space and wherein in the combustion space, in addition to compression of the air-fuel mixture by the movement of the piston, the gas in a jet condition each ejected from each of the ejection openings is caused to collide in a given region, whereby the air-fuel mixture is compressed while generating a colliding jet.

4. The free-piston engine according to claim 3, wherein each of the ejection openings is disposed axisymmetrically with respect to the center axis of the combustion space and wherein the exhaust port is provided with exhaust openings which open to the combustion space, and the exhaust openings are provided at least in the same number as the ejection openings, is disposed to each of the ejection openings in a manner corresponding to the axis line direction of the combustion space, and is provided so that part of the exhaust gas discharged from the exhaust openings is capable of ejection from each of the corresponding ejection openings together with the gas.

5. The free-piston engine according to claim 3, wherein the exhaust port is provided with an exhaust opening which opens to the combustion space and is provided in such a manner that part of the exhaust gas discharged from the exhaust opening is capable of ejection from each of the ejection openings together with the gas and wherein the exhaust gas port is provided with means for controlling the ejection amount of the exhaust gas from each of the ejection openings according to the combustion condition of the combustion space.

6. The free-piston engine according to claim 1, wherein the piston and the piston type valve are configured in that immediately before combustion in the combustion space, the piston is moved in a direction from the most-compressed position to the most-expanded position and/or the piston type valve is moved from the initial position in a direction in which discharge of the exhaust gas to the exhaust port is accelerated.

7. The free-piston engine according to claim 3, further comprising a controller which controls the actuation of the piston drive device and the valve drive device and the condition of the gas introduced into the combustion space, wherein the controller is provided with performing the control in such a manner as to permit switching between a first mode for performing combustion by only the compression of the piston without generating the colliding jet in the combustion space and a second mode for performing combustion by generating the colliding jet in the combustion space.

8. The free-piston engine according to claim 2, further comprising a controller which controls the actuation of the piston drive device and the valve drive device, wherein the controller is provided with controlling the actuation of the piston drive device and the valve drive device so that the negative pressure increases gradually from a start of the engine by adjusting the distance between the piston and the piston type valve.

9. The free-piston engine according to claim 3, wherein the combustion space is provided in such a manner that the exhaust gas is introduced from the exhaust port at the same time with the introduction of the gas and the exhaust gas can collide with the colliding jet.

10. The free-piston engine according to claim 3, wherein the ejection opening is provided in such a manner that a formed edge thereof has a shape of a noncircular curved line.

11. The free-piston engine according to claim 3, wherein the piston and the piston type valve are configured in such a manner that the piston performs a cycle of returning from the most-compressed position to a next most-compressed position a whole number of times while the piston drive device is performing a cycle of returning from the initial position to a next initial position once or the piston type valve performs the cycle thereof a whole number of times while the piston is performing the cycle thereof once.

12. The free-piston engine according to claim 3, further comprising means for creating a stop cycle in which only outside air not containing the fuel is introduced into the combustion space and combustion is not performed.

13. The free-piston engine according to claim 3, wherein each of the ejection openings is provided in such a manner as to be capable of supplying the jet to the combustion space in a direction in which the given region is formed near the exhaust port.

14. A free-piston engine, comprising:

a combustion space for combusting an air-fuel mixture of outside air and a fuel;

a piston provided so as to be capable of reciprocation between a most-compressed position, which minimizes a volume of the combustion space, and a most-expanded position, which maximizes the volume;

a piston drive device which causes the piston to go into action;

a suction port which introduces the outside air or a gas composed of the air-fuel mixture into the combustion space; and an exhaust port which directs an exhaust gas generated in the combustion space to outside of the free-piston engine;

wherein the piston extracts power by moving from the most-compressed position to the most-expanded position by an explosive force due to the combustion of the air-fuel mixture in the combustion space and is provided in such a manner as to return from the most-expanded position to the most-compressed position by the actuation of the piston drive device, and at the same time the piston functions as a valve of the exhaust port and opens the exhaust port to the combustion space when the piston has reached the most-expanded position, whereas the piston closes the exhaust port to the combustion space when the piston is present in a different position, wherein the suction port is provided with a plurality of ejection openings each formed so as to be capable of ejecting the outside air or the gas composed of the air-fuel mixture toward a given region positioned in a middle of the interior of the combustion space, wherein in the combustion space, in addition to compression of the air-fuel mixture by the movement of the piston, the outside air or the gas composed of the air-fuel mixture each ejected from each of the ejection openings is caused to collide in the given region, whereby the air-fuel mixture is compressed while generating a colliding jet, and wherein the ejection openings are provided in places in which the ejection openings are always open to the interior of the combustion space regardless of the position of the piston.

15. The free-piston engine according to claim 14, further comprising:

a rotary valve capable of switching between an open position permitting taking-in of the gas from the suction port into the combustion space and a closed position prohibiting taking-in of the gas from the suction port into the combustion space, wherein the rotary valve is provided with a hole part which connects and communicates with the suction port at a time of the open position and a surface part which is positioned around the hole part and faces the suction port at a time of the closed position, and switches the opening and closing of the suction port by rotating around the center axis of the combustion space.

16. The free-piston engine according to claim 15, wherein the rotary valve is provided in such a manner that a formed edge of the hole part is formed to have a non-circular-arc curved line and/or that a wall thickness of a region on an outer circumferential side increases gradually toward a center so as to be capable of restricting gas separation during passage through the hole part.

17. The free-piston engine according to claim 14, wherein the piston and the exhaust port are provided in a pair in a direction along the center axis of the combustion space and are disposed so as to be mutually symmetric around the suction port, the combustion space is formed between each of the pistons, and the pistons move so as to depart from each other and come close to each other.

18. The free-piston engine according to claim 1, wherein the suction port is formed in such a manner that the suction port includes a suction opening which takes in the outside air from the outside of the free-piston engine, the suction opening opens to a surface part of a movable body on which the free-piston engine is mounted, whereby during the movement of the movable body, it is possible to restrict a change from a laminar flow to a turbulent flow of an airflow along the surface part.

19. The free-piston engine according to claim 3, wherein on an upstream side of the suction port, there is provided a supercharger or a turbocharger which raises the pressure of the gas before introduction into the suction port and permits the gas to be introduced into the combustion space in a jet condition even when the pressure in the combustion space is in a condition of not less than the atmospheric pressure.

20. The free-piston engine according to claim 2, wherein the suction port is provided with a plurality of ejection openings each formed so as to be capable of ejecting the gas toward a given region positioned in a middle of the interior of the combustion space and wherein in the combustion space, in addition to compression of the air-fuel mixture by the movement of the piston, the gas in a jet condition each ejected from each of the ejection openings is caused to collide in a given region, whereby the air-fuel mixture is compressed while generating a colliding jet.

* * * * *